US009761945B2

(12) United States Patent
Zuniga

(10) Patent No.: US 9,761,945 B2
(45) Date of Patent: Sep. 12, 2017

(54) ULTRA-LOW PROFILE MONOPOLE ANTENNA FOR 2.4GHZ BAND

(71) Applicant: TAOGLAS GROUP HOLDINGS LIMITED, Wexford (IE)

(72) Inventor: Eleazar Zuniga, Escondido, CA (US)

(73) Assignee: TAOGLAS GROUP HOLDINGS LIMITED, Wexford (IE)

( * ) Notice: Subject to any disclaimer, the term of this patent is extended or adjusted under 35 U.S.C. 154(b) by 81 days.

(21) Appl. No.: 14/607,758

(22) Filed: Jan. 28, 2015

(65) Prior Publication Data

US 2015/0303571 A1 Oct. 22, 2015

Related U.S. Application Data

(63) Continuation-in-part of application No. 14/519,040, filed on Oct. 20, 2014, now abandoned.

(60) Provisional application No. 61/892,844, filed on Oct. 18, 2013.

(51) Int. Cl.

| | |
|---|---|
| ***H01Q 7/00*** | (2006.01) |
| ***H01Q 1/38*** | (2006.01) |
| ***H01Q 9/27*** | (2006.01) |
| ***H01Q 1/22*** | (2006.01) |
| ***H01Q 9/42*** | (2006.01) |

(52) U.S. Cl.

CPC ..... *H01Q 7/00* (2013.01); *H01Q 1/2208* (2013.01); *H01Q 1/2225* (2013.01); *H01Q 1/38* (2013.01); *H01Q 9/27* (2013.01); *H01Q 9/42* (2013.01)

(58) Field of Classification Search

CPC ..... H01Q 7/00; H01Q 1/38; H01Q 1/2216; H01Q 1/2225

USPC ..... 343/867; 340/572.7

See application file for complete search history.

(56) References Cited

U.S. PATENT DOCUMENTS

| | | | | |
|---|---|---|---|---|
| 5,914,862 | A * | 6/1999 | Ferguson | G06K 19/04 340/572.7 |
| 7,463,154 | B2 * | 12/2008 | Cortina | G06K 19/07 235/492 |
| 8,146,830 | B2 * | 4/2012 | Johnson | G06K 19/07749 235/487 |
| 8,508,429 | B2 * | 8/2013 | Nishioka | H01Q 5/35 235/492 |
| 2001/0000659 | A1 * | 5/2001 | Hayashi | G06K 7/0008 340/10.34 |
| 2001/0020897 | A1 * | 9/2001 | Takatori | G06K 19/0704 340/572.7 |
| 2002/0163434 | A1 * | 11/2002 | Burke | G08B 13/2414 340/572.7 |

(Continued)

*Primary Examiner* — Dameon E Levi
*Assistant Examiner* — Ab Salam Alkassim, Jr.
(74) *Attorney, Agent, or Firm* — Coastal Patent Law Group, P.C.

(57) ABSTRACT

The disclosure concerns an ultra-small and ultra-low profile monopole antenna for configured for use in ISM bands. The antenna generally includes a flexible substrate having a printed conductor pattern thereon. The printed conductor pattern includes: a first conductor portion having a first solder pad and at least two concentric loops, and preferably three concentric loops extending therefrom, with a rectangular trace pad disposed within the concentric loops; and a second conductor portion defined by a conductor sheet being disposed adjacent to the first conductor portion, the conductor sheet having a second solder pad thereon. The antenna is configured to attach with a coaxial cable having a feed wire coupled to the first solder pad and further having a ground wire coupled to the second solder pad.

5 Claims, 1 Drawing Sheet

(56) References Cited

U.S. PATENT DOCUMENTS

2006/0038686 A1* 2/2006 Casden ..... G06K 7/10336 340/572.7
2006/0164249 A1* 7/2006 Lutz ..... G06K 19/07749 340/572.7
2007/0236398 A1* 10/2007 Nam ..... H01Q 1/243 343/702
2007/0257799 A1* 11/2007 Bauchot ..... G06K 19/07749 340/572.1
2008/0143480 A1* 6/2008 Egbert ..... H04B 5/0062 340/10.1
2008/0246664 A1* 10/2008 Ikemoto ..... G06K 19/07749 343/700 MS
2009/0231139 A1* 9/2009 Heurtier ..... G06K 19/0724 340/572.7
2010/0103058 A1* 4/2010 Kato ..... G06K 19/07749 343/702
2010/0148968 A1* 6/2010 Casden ..... G06K 7/10336 340/572.7
2011/0090058 A1* 4/2011 Ikemoto ..... H01Q 5/35 340/10.1
2013/0033403 A1* 2/2013 Oh ..... H01Q 7/00 343/741
2013/0147675 A1* 6/2013 Kato ..... H01Q 1/38 343/788
2014/0015715 A1* 1/2014 Kadosawa ..... H01Q 9/42 343/702
2014/0035793 A1* 2/2014 Kato ..... H01Q 1/243 343/867
2014/0117927 A1* 5/2014 Chateau ..... H04B 5/0075 320/108
2014/0145906 A1* 5/2014 Kato ..... H01Q 7/00 343/867
2015/0054704 A1* 2/2015 Hwang ..... G06K 7/10336 343/788

* cited by examiner

ULTRA-LOW PROFILE MONOPOLE ANTENNA FOR 2.4GHZ BAND

CROSS-REFERENCE TO RELATED APPLICATIONS

This application is a continuation in part (CIP) of U.S. Ser. No. 14/519,040, filed Oct. 20, 2014;

which claims benefit of priority with U.S. Provisional Ser. No. 61/892,844, filed Oct. 18, 2013;

the contents of each of which is hereby incorporated by reference.

BACKGROUND

Field of the Invention

This invention relates to antennas for wireless communication; and more particularly, to an ultra-low profile monopole antenna for 2.4 GHz band resonances.

Description of the Related Art

The industrial, scientific and medical (ISM) bands include the resonances between 2.4 GHz and 2.5 GHz, and are used publicly around the world. Various industrial, scientific, and medical equipment are configured to communicate in the ISM bands. Examples include Bluetooth technology, near field communication (NFC), WiFi, and others.

There remains a need for improved antennas for use in the ISM bands, including: such antennas having reduced size or being miniaturized while maintaining high efficiency; antennas having flexible form for embedding against the contour of a housing or similar device surface; and such antennas being readily integrated with a device housing or other surface, or attached therewith.

SUMMARY OF THE INVENTION

An ultra-small and ultra-low profile monopole antenna for configured for use in ISM bands is disclosed. The antenna comprises a flexible substrate having a printed conductor pattern thereon. The printed conductor pattern includes: a first conductor portion having a first solder pad and at least two concentric loops, and preferably three concentric loops extending therefrom, with a rectangular trace pad disposed within the concentric loops; and a second conductor portion defined by a conductor sheet being disposed adjacent to the first conductor portion, the conductor sheet having a second solder pad thereon. The antenna is configured to attach with a coaxial cable having a feed wire coupled to the first solder pad and further having a ground wire coupled to the second solder pad.

DETAILED DESCRIPTION OF THE PREFERRED EMBODIMENTS

An ultra-small and ultra-low profile monopole antenna for 2.4 GHz band configured for use among Bluetooth, Wi-Fi, ZigBee and ISM bands is described. The antenna has a peak gain of 2.5 dBi at 2.4 GHz and efficiencies of 45%.

This antenna is unique because it is made from polyflexible material, has a tiny form factor (5.9 mm×4.1 mm×0.24 mm in one embodiment) and has double-sided 3M tape for easy "peel and stick" mounting.

The cable routes conveniently directly out of the bottom of the antenna, reducing the volume consumed by the antenna within the device to an absolute minimum compared to other designs. This antenna is the ideal all-round antenna solution for fitting into narrow spaces and still maintaining high performance, for example on the inside top or adjacent side applied directly to the plastic housing of LCD monitors, tablets, smartphones.

Figure 1:
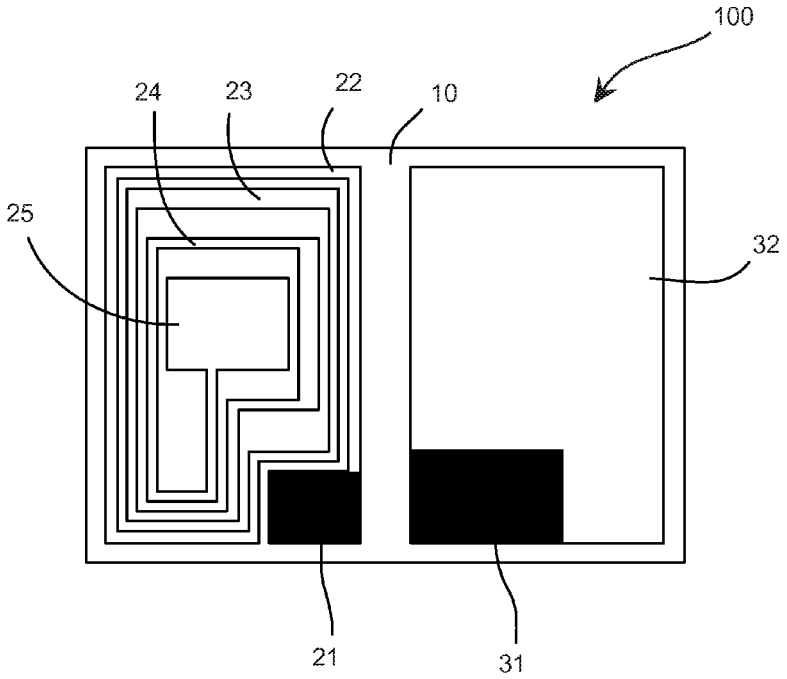
FIG. 1 shows an ultra-small and ultra-low profile monopole antenna for configured for use in ISM bands.

Turning to the drawings, FIG. 1 shows the ultra-small and ultra-low profile monopole antenna assembly 100 for 2.4 GHz band. The antenna assembly comprises a rectangular substrate sheet 10 having a first portion forming a left side of the sheet and a second portion forming a rights side of the sheet. The substrate sheet is a flexible substrate sheet, such as a polyimide sheet or other flexible substrate sheet. A conductive trace is disposed within the first portion of the flexible substrate, the conductor extending from a first conductor pad 21 to form a first loop 22, second loop 23, and third loop 24, with each of said loops formed within one another, respectively, and a rectangular trace pad 25 disposed at a terminus of the trace, the rectangular trace pad being contained or surrounded by each of the concentric trace loops. It is important to note that each of the loops 22-24 individually comprises at least a first vertical portion extending from a bottom end to a top end, a first horizontal portion extending from a right end to a left end, a second vertical portion extending from the top end to the bottom end, and a second horizontal portion extending from the left end to the right end, thus completing a respective loop. Moreover, from the first solder pad extends the first of the concentric loops, the second of the concentric loops being disposed within the first loop, and the third concentric loop being disposed within the second loop. The second portion of the flexible substrate comprises a rectangular conductor sheet 32 to serve as a ground conductor, and a second solder pad 31 disposed at a bottom left corner of the conductor sheet.

The conductive trace and conductor sheet can be formed from copper, such as by way of copper deposition, printing or etching among other known metallization techniques.

The first and second solder pads can be formed from tin, such as by tin plating or other known metallization techniques.

The antenna assembly can comprise an adhesive disposed on a read surface of the substrate opposite of the conductive trace and other conductive components. The adhesive provides a mechanism for attaching the antenna assembly within a host device housing or other suitable location.

Figure 2:
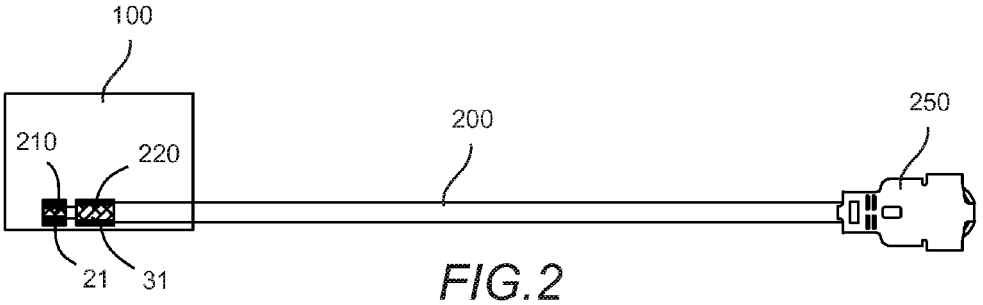
FIG. 2 shows the antenna from a top view being attached to a conventional coaxial cable.
Figure 3:
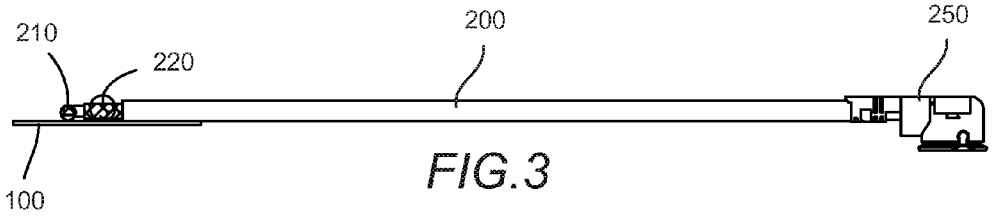
FIG. 3 shows the antenna from a side view being attached to a conventional coaxial cable.

FIGS. 2-3 show the antenna assembly 100 with an attached coaxial cable 200. The coaxial cable comprises a first conductor 210 coupled to the first solder pad 21, and a second conductor 220 coupled to the second solder pad 31. A terminal end of the cable may comprise a suitable connection adapter 250 for connecting the antenna to a radio circuit.

Each of the concentric loops can be bent to conform about the first solder pad, or alternatively the loops can comprise rectangular loops. The rectangular trace pad 25 and surrounding trace loops 22-24 are configured with a size for producing a resonance in the 2.4 GHz ISM band. It has been determined that using a substrate having dimensions of 5.9 mm×4.1 mm×0.24 mm will be sufficient to produce the described antenna. Thus, the resulting antenna achieves an ultra-low profile monopole type antenna for the 2.4 GHz bands.

What is claimed is:

1. An ultra-low profile monopole antenna for 2.4 GHz band, comprising:

a flexible substrate sheet having a first portion adjacent a second portion;

a conductive trace being disposed on the first portion of the substrate sheet; and a conductive sheet being disposed on the second portion of the substrate sheet, the conductive sheet comprising a second solder pad;

the conductive trace disposed on the first portion comprising:

a first solder pad;

a first loop connected to the first solder pad, the first loop having a first vertical portion extending from the first solder pad, a first horizontal portion extending from the first vertical portion, a second vertical portion extending from the first horizontal portion, and a second horizontal portion extending from the second vertical portion;

a second loop connected to the first loop, the second loop being concentrically disposed with the first loop;

a third loop connected to the second loop, the third loop being concentrically disposed with the second loop; and a rectangular trace pad disposed within the third loop;

wherein the conductive trace comprises a first peripheral dimension, the conductive sheet comprises a second peripheral dimension, and the second peripheral dimension is equal in size to the first peripheral dimension; and wherein the antenna is configured to attach with a coaxial cable having a feed line coupled to the first solder pad and further having a ground line coupled to the second solder pad.

2. The antenna of claim 1 wherein the antenna comprises a dimension less than or equal to: 5.9 mm×4.1 mm×0.24 mm.

3. The antenna of claim 1, wherein said flexible substrate sheet comprises a polyimide sheet.

4. The antenna of claim 1, wherein one or more of the concentric loops is bent to contour at least two sides of a perimeter of the first solder pad.

5. The antenna of claim 1, wherein said loops comprise rectangular loops.

* * * * *